US005419618A

United States Patent [19]

Hatcher

[11] Patent Number: 5,419,618

[45] Date of Patent: May 30, 1995

[54] ERGONOMIC FOOTREST

[75] Inventor: David M. Hatcher, Buffalo, N.Y.

[73] Assignee: Posting Equipment Corporation, Buffalo, N.Y.

[21] Appl. No.: 142,582

[22] Filed: Oct. 25, 1993

[51] Int. Cl.[6] ..... A47C 7/50

[52] U.S. Cl. ..... 297/423.46; 297/423.45

[58] Field of Search ..... 297/423.45, 423.46, 297/423.44, 423.24; 108/10, 6, 8

[56] References Cited

U.S. PATENT DOCUMENTS

| | | | |
|---|---|---|---|
| 815,046 | 3/1906 | Sherman | 297/423.40 X |
| 1,217,246 | 2/1917 | Wallace | 297/423.45 |
| 2,248,369 | 7/1941 | Ludersen | 297/423.40 X |
| 4,228,745 | 10/1980 | Gale | 297/423.45 X |

FOREIGN PATENT DOCUMENTS

| | | | |
|---|---|---|---|
| 1193215 | 5/1965 | Germany | 297/423.45 |
| 675347 | 9/1990 | Switzerland | 108/10 |
| 2153217 | 8/1985 | United Kingdom | 297/423.46 |

OTHER PUBLICATIONS

Misco Fall 1993 Computer Products Catalog, p. 125.

*Primary Examiner*—Laurie K. Cranmer

*Attorney, Agent, or Firm*—Hodgson, Russ, Andrews, Woods & Goodyear

[57] ABSTRACT

A footrest wherein the height and angle are adjustable independently of each other to provide operator flexibility and position preference to maximize ergonomic comfort.

9 Claims, 3 Drawing Sheets

ERGONOMIC FOOTREST

The present invention relates generally to footrests.

Conventionally, a footrest has a base and a platform having an upper surface upon which the user's feet rest. The platform may be mounted such that the angle which the upper surface makes with the floor is adjustable, and the height of the upper surface may also be adjustable. However, flexibility and position preference suffers when adjustment of the height or angle affects the other.

It is accordingly an object of the present invention to provide operator flexibility and position preference to maximize ergonomic comfort for the user of a footrest.

In order to achieve such an object, in accordance with the present invention the height and angle are adjustable independently of each other.

The above and other objects, features, and advantages of the present invention will be apparent in the following detailed description of the preferred embodiment when read in conjunction with the accompanying drawings wherein the same reference numeral denotes the same or similar parts throughout the several views.

DETAILED DESCRIPTION OF THE PREFERRED EMBODIMENT

Figure 1:
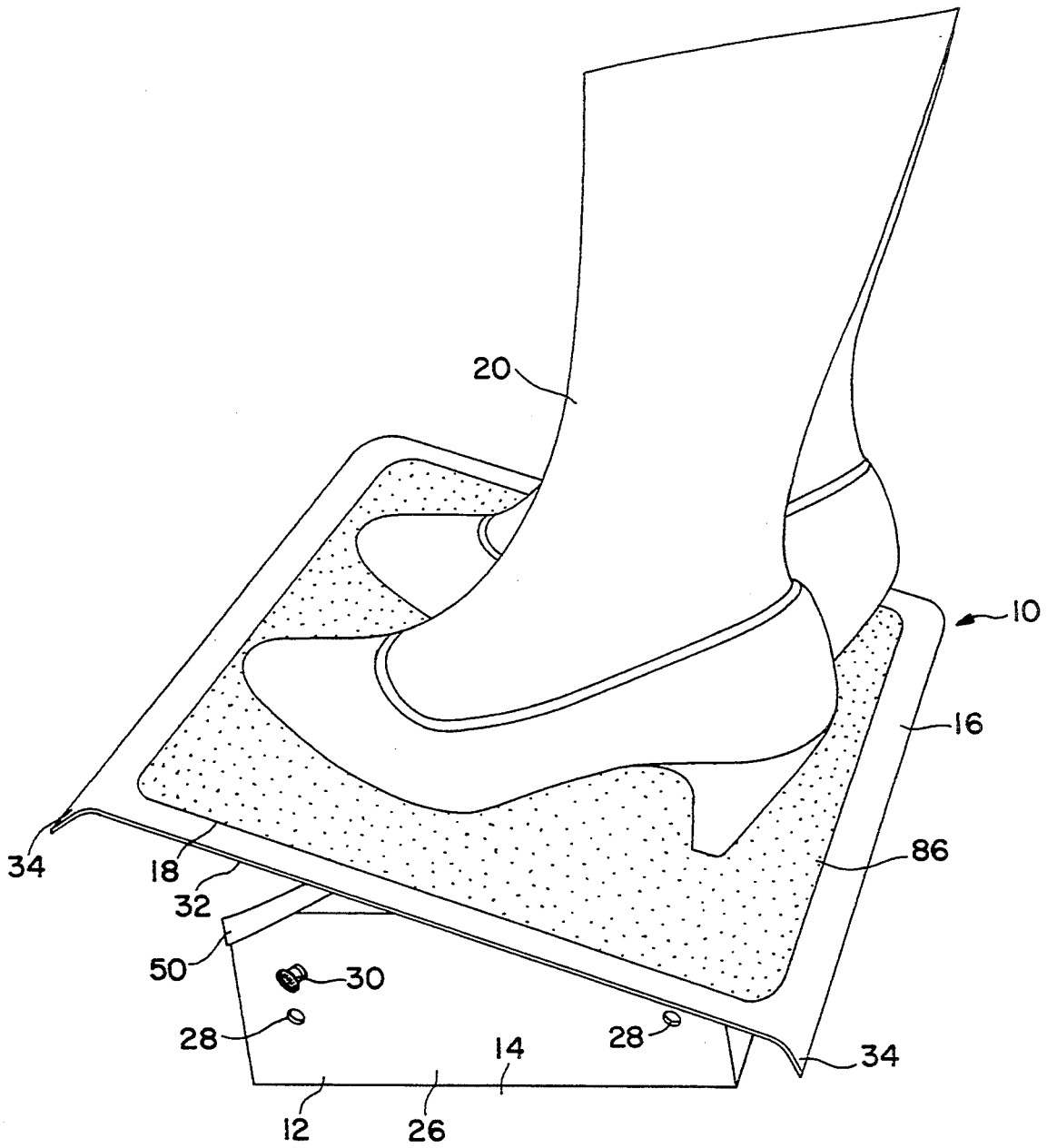
FIG. 1 is a perspective view of a footrest which embodies the present invention in use.
Figure 2:
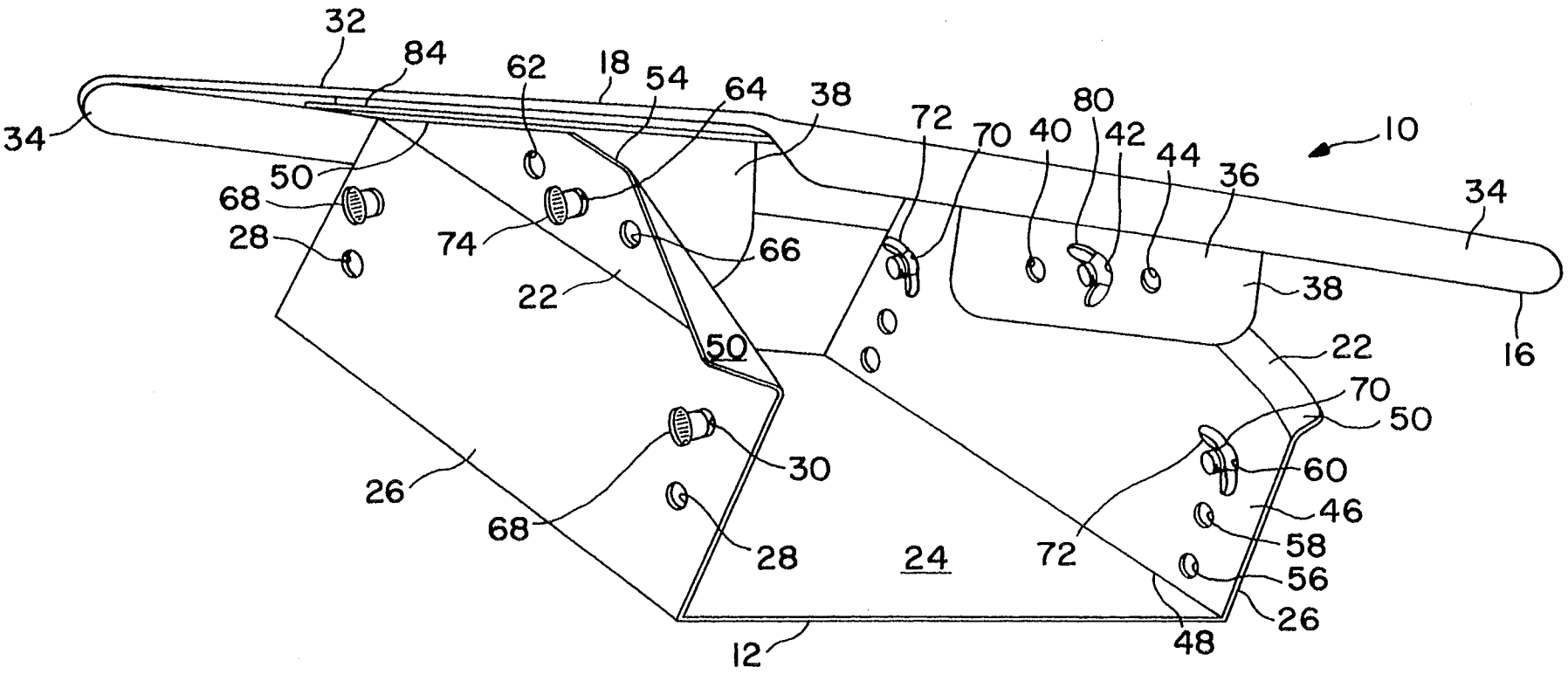
FIG. 2 is a view similar to that of FIG. 1 of the footrest.

Referring to FIGS. 1 and 2, there is shown generally at 10 a footrest which includes a base 12 for engaging a floor, illustrated at 14, and a platform 16 having an upper surface 18 for receiving a person's feet 20 for resting of the feet thereon. The platform 16 is connected to the base 12 by a pair of members or mounts 22 as discussed hereinafter. The footrest 10 may suitably be made of static-dissipating steel which may, for example, be 18 gage for the base 12 and mounts 22 and be 16 gage for the platform or rest 16.

The base 12 is formed to have a generally flat horizontal portion 24 which contacts the floor and a pair of generally flat vertical portions 26 which extend upwardly from the sides of portion 24 and normal thereto. The terms "horizontal" and "vertical", as used herein, are with reference to the footrest in a position with the portion 24 engaging a floor for normal use thereof. Along each of the forward and rear edges of each of the portions 26 are a pair of vertically spaced and aligned apertures 28 and 30.

The platform or rest 16 comprises a generally flat member 32 containing upper surface 18 and formed along its forward and rear edges to have downwardly curved edge portions 34. Riveted or otherwise suitably attached to member 32 is a plate 36 formed to have two portions 38 which extend downwardly from member 32, i.e., normal thereto.

Each of the plate portions 38 contains, generally centrally thereof, three apertures 40, 42, and 44 spaced and aligned horizontally, i.e., along a line parallel to the upper surface 18.

Each of the mounts 22, which lies inwardly of and along side the respective base portion 26 and outwardly of and along side the respective platform portion 38, comprises a generally flat vertical portion 46 having a lower horizontal edge 48. Its upper edge portion along upper horizontal edge 54 extends above the respective base portion 26 and is formed to have generally flat outwardly-extending tab portions 50 on respectively opposite sides for engaging the underside of platform portion 32. The tabs 50 are inclined at an angle, illustrated at 52, which is the angle of the tabs relative to horizontal base portion 24 or upper horizontal edge 54. Along each of the forward and rear edges of each of the mounts 22 are three apertures 56, 58 and 60 which are vertically spaced and aligned and which correspond to and cooperate with the respective set of apertures 28 and 30 for connection of the mounts to the base as described hereinafter. Centrally between the forward and rear edges of each mount 22 and in the upper edge portion thereof are three apertures 62, 64, and 66 which are spaced horizontally, i.e., along a line parallel to horizontal base portion 24, the center of the central aperture 64 being slightly below the centers of apertures 62 and 66, perhaps by a distance equal to half of the aperture diameter, for reasons which will be discussed hereinafter.

Each of the mounts 22 is detachably attached to the respective base vertical portion 26 by a pair of sets of a thumb screw 68, lock washer 70, and butterfly wing nut 72, or by other suitable means, wherein each thumb screw is received in one of the base apertures 28 and 30 and one of the mount apertures 56, 58, and 60 at the respective edge of the base vertical portion.

Each of the mounts 22 is also pivotly detachably attached to the respective platform portion 38 by a thumb screw 74, nylon washer 76, lock washer 78, and butterfly wing nut 80, or by other suitable means wherein the thumb screw 74 is received within the nylon washer 76 which is in turn received in the respective center apertures 42 and 64 in the platform portion 38 and the mount portion 46 respectively, apertures 42 and 64 being enlarged to receive washer 76. The nylon washer 76 is provided to minimize friction for pivoting movement more easily of the platform 16 relative to the base 12.

Suitable self-adhesive friction strips or pads, illustrated at 82, are adhesively attached to the lower or floor-engaging surface of the base portion 24 at the corners thereof to provide slide resistance for use of the footrest on smooth or carpeted floors. Suitable self-adhesive friction strips, illustrated at 84, are adhesively attached to the lower surface of platform portion 32 adjacent and outwardly of vertical plate portions 38 for engagement softly by the tab portions 50. The upper feet-engaging surface 18 of the platform is covered substantially by a self-adhesive black anti-skid pebbled wear foot mat 86 to prevent shoes from slipping. The finish for the footrest members may be a pearl gray epoxy coating compatible with hardware and office surroundings.

Figure 3A:
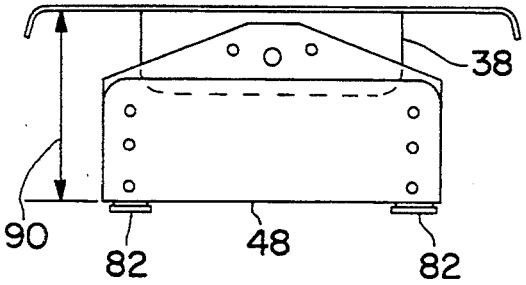
FIGS. 3*a*, 4*a*, and 5*a* are diagrammic views thereof adjusted to different heights.
Figure 4A:
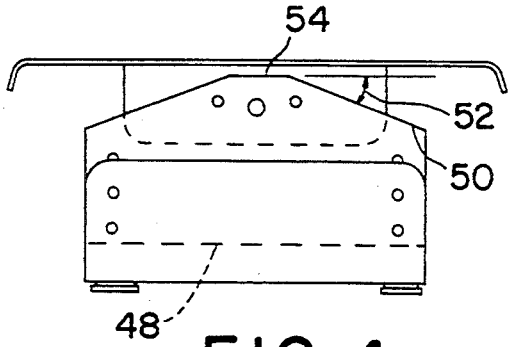
Figure 5A:
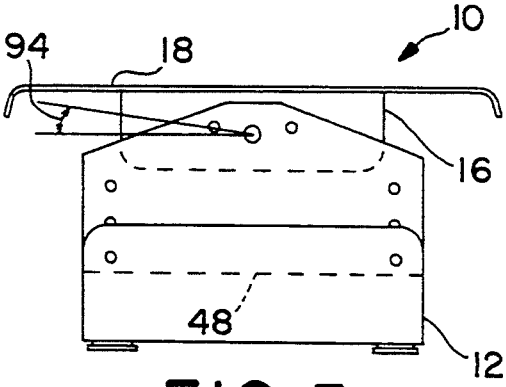

In accordance with the present invention, the height and angle of the footrest 10 are independently adjustable, i.e., an adjustment in height, illustrated at 90, of the upper surface 18 (when it is pivoted about pivot axis, illustrated at 88, to a horizontal position, as illustrated in FIGS. 3*a*, 4*a* and 5*a*) does not affect the angle, illustrated at 92, of the platform upper surface 18 relative to its horizontal position, and a change in the angle does not affect the height. Such independent adjustment is provided for operator flexibility and position preference to maximize ergonomic comfort for the user. Thus, the height is adjustable by means of the apertures 56, 58 and 60 and apertures 28 and 30. Angle adjustability is independently provided by apertures 40, 42 and 44 and apertures 62, 64 and 66.

In order to adjust the height 90, the thumb screws 68 are removed and the mounts 22 moved up or down until one of the apertures 28 and 30 along each edge aligns with one of the apertures 56, 58 and 60 at which time the thumb screws are inserted and the mounts attached by means of the lock washers and wing nuts, for example, as illustrated in FIGS. 3*a*, 4*a*, and 5*a*, the height 90 may perhaps be adjusted between heights of 4 1/16 inches, 4 13/16 inches, and 6 9/16 inches respectively to relieve pressure on and improve circulation in the thighs and lower legs.

Figure 3B:
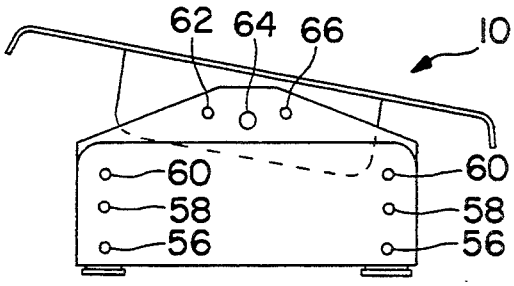
FIGS. 3*b*, 4*b*, and 5*b* are views similar to those of FIGS. 3*a*, 4*a*, and 5*a* with the footrest adjusted to the different heights respectively and adjusted to the same angle.
Figure 4B:
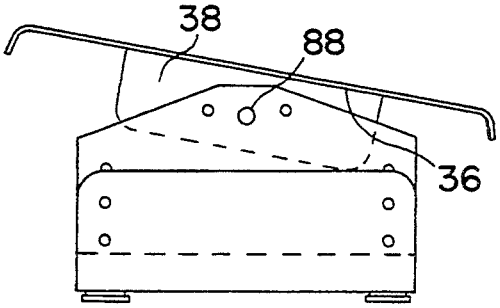
Figure 5B:
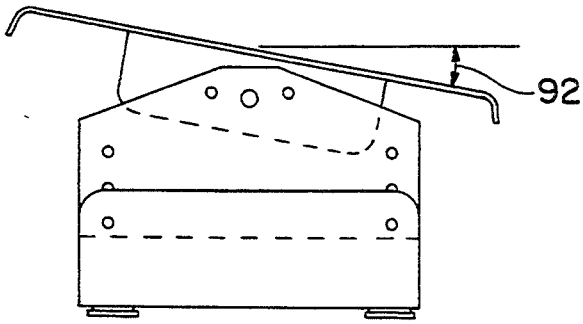
Figure 6:
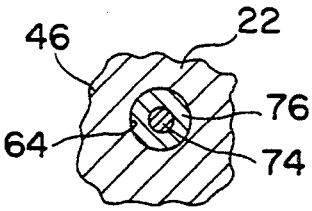
FIG. 6 is a partial sectional view illustrating the connection of the base and platform thereof.

Dynamic foot movement freely adjusts the platform angle 92 independent of the height, as illustrated in FIGS. 3*b*, 4*b* and 5*b*, with the tab portions 50 acting as stops limiting the angle 92 through which platform 16 may be pivoted to angle 52. This "exercise" feature allows the operators to stretch legs and flex muscles and thereby improve circulation and reduce muscular fatigue. For example, the tab portions 50 may be formed to provide an angle 52 of perhaps about 20 degrees to thus allow free-floating pivoting movement of the platform through an angle 92 of plus and minus 20 degrees.

The angle 92 may be locked at a predetermined angle by pivoting the platform to align one of apertures 62 and 66 with the corresponding one of apertures 40 and 44 and inserting a thumb screw, which may be similar to thumb screw 68, and applying a lock washer and wing nut, which may be similar to lock washer 70 and wing nut 72. As previously stated, aperture 64 is at a lesser height then apertures 62 and 66. A line joining the center of aperture 64 with one of the apertures 62 and 66 forms an angle, illustrated at 94 in FIG. 5*a*, which is equal to the angle 92 at which the platform is locked. For example, angle 94 may be selected to be about 10 degrees to provide a platform angle 92 of about 10 degrees, which appears to be preferred by many users. When not using this locking feature, the screws, lock washers, and wing nuts used therefor may be retained in the spare holes in the base. The use of footrest 10 may help to reduce lower back fatigue.

The following example of additional dimensions is provided for exemplary purposes only and is not intended to limit the present invention. The base length between portions 26 may perhaps be about 10⅜ inches, its width may perhaps be about 7½ inches, and the height of portions 26 may perhaps be about 2 9/16 inches. The apertures 28 and 30 may each have a diameter of perhaps about 9/32 inch, the distance between centers thereof may perhaps be about ¾ inch, and the center of aperture 28 may be perhaps about 1⅛ inch from portion 24. The upper surface 18 may perhaps be about 11 inches by 16 inches. The distance between portions 38 may perhaps be about 10 5/32 inches, the length and height of each portion 38 may perhaps be about 5¾ inches and 1½ inches respectively. The height of each mount may perhaps be about 3½ inches. Apertures 42 and 64 may each have a diameter of perhaps about 25/64 inch to accommodate nylon washer 76. Apertures 40, 44, 62, and 66 may each have a diameter of perhaps about 9/32 inch.

It should be understood that while the invention has been described in detail herein, the invention can be embodied otherwise without departing from the principles thereof. For example, additional apertures may be provided to lock the footrest to more than an angle 94 of 10 degrees. Such other embodiments are indeed meant to come within the scope of the present invention as defined in the appended claims.

What is claimed is:

1. A footrest comprising a base, a platform having an upper surface for receiving a person's feet, said platform comprising a generally flat portion defining said upper surface and a pair of planar portions extending downwardly from said generally flat portion, said base comprising a floor-engaging portion and a pair of planar vertical portions, a pair of planar members for attachment to said platform and to said base for mounting said platform to said base, said mounting members disposed outwardly of said platform planar portions respectively and inwardly of said base planar portions respectively, means including pivot axis means for attaching said mounting members to said platform planar portions respectively for angle adjustment of said platform upper surface relative to a floor on which said base is received, and height adjustment means for attaching said mounting members to said pair of base planar vertical portions respectively for height adjustment of said pivot axis means relative to the floor whereby the angle and height are adjustable independently of each other, each of said mounting members including means comprising a pair of outwardly-extending tab portions inclined relative to said floor-engaging portion on opposite sides of said pivot axis means for engaging said platform flat portion for limiting the angle through which said platform is pivotable.

2. A footrest according to claim 1 including means for locking the angle at a predetermined angle.

3. A footrest according to claim 2 wherein said locking means comprises first aperture means in each of said planar mounting members and aperture means in each of said platform planar portions wherein said first aperture means in each of said mounting members is alignable with said aperture means in said respective platform planar portion at said predetermined angle for receiving a connecting means.

4. A footrest according to claim 3 wherein said height adjustment means comprises second aperture means in each of said mounting members and aperture means in each of said base vertical portions wherein said second aperture means in each of said mounting members is alignable with said aperture means in said respective base vertical portion for receiving a connecting means.

5. A footrest according to claim 4 wherein at least one of said planar mounting member first aperture means and said base vertical portion aperture means comprises a pair of pluralities of vertically spaced apertures.

6. A footrest according to claim 2 wherein said height adjustment means comprises aperture means in each of said mounting members and aperture means in each of said base vertical portions wherein said aperture means in each of said mounting members is alignable with said aperture means in said respective base vertical portion for receiving a connecting means.

7. A footrest according to claim 6 wherein at least one of said mounting member aperture means and said base vertical portion aperture means comprises a pair of pluralities of vertically spaced apertures.

8. A footrest according to claim 1 wherein said height adjustment means comprises aperture means in each of said planar mounting members and aperture means in each of said base vertical portions wherein said aperture means in each of said planar mounting members is alignable with said aperture means in said respective base vertical portion for receiving a connecting means.

9. A footrest according to claim 8 wherein at least one of said mounting member aperture means and said base vertical portion aperture means comprises a pair of pluralities of vertically spaced apertures.

* * * * *